US006877556B2

(12) United States Patent
Wittle et al.

(10) Patent No.: US 6,877,556 B2
(45) Date of Patent: Apr. 12, 2005

(54) ELECTROCHEMICAL PROCESS FOR EFFECTING REDOX-ENHANCED OIL RECOVERY

(75) Inventors: J. Kenneth Wittle, Chester Springs, PA (US); Christy W. Bell, Berwyn, PA (US)

(73) Assignee: Electro-Petroleum, Inc., Wayne, PA (US)

( * ) Notice: Subject to any disclaimer, the term of this patent is extended or adjusted under 35 U.S.C. 154(b) by 187 days.

(21) Appl. No.: 10/279,431

(22) Filed: Oct. 24, 2002

(65) Prior Publication Data

US 2003/0102123 A1 Jun. 5, 2003

Related U.S. Application Data

(60) Provisional application No. 60/335,701, filed on Oct. 26, 2001.

(51) Int. Cl.[7] ..... E21B 43/24
(52) U.S. Cl. ..... 166/248; 166/272
(58) Field of Search ..... 166/248, 272, 166/302

(56) References Cited

U.S. PATENT DOCUMENTS

| | | | | |
|---|---|---|---|---|
| 3,724,543 A | | 4/1973 | Bell et al. | |
| 3,782,465 A | | 1/1974 | Bell et al. | |
| 3,915,819 A | | 10/1975 | Bell et al. | |
| 3,980,053 A | * | 9/1976 | Horvath | 123/3 |
| 4,206,024 A | * | 6/1980 | Carpenter et al. | 205/766 |
| 4,382,469 A | | 5/1983 | Bell et al. | |
| 4,473,114 A | | 9/1984 | Bell et al. | |
| 4,495,990 A | | 1/1985 | Titus et al. | |
| 5,074,986 A | | 12/1991 | Probstein et al. | |
| 5,595,644 A | | 1/1997 | Doring et al. | |
| 5,738,778 A | | 4/1998 | Doring | |

OTHER PUBLICATIONS

Connors, Thomas F., et al., "Determination of Standard Potentials and Electron–Transfer Rates for Halobiphenyls from Electrocatalytic Data", Analytical Chemistry, Jan. 1985, vol. 57 No. 1, pp. 170–174.

Liu, Zhijie, et al. "Electrolytic Reduction of Low Molecular Weight Chlorinated Aliphatic Compounds: Structural and Thermodynamic Effects on Process Kinetics", Environmental Science and Technology, Jan. 2000, vol. 34 No. 5, pp. 804–811.

Shirai, Kimihiro, et al. "Electrochemical Oxidation of 2,2,2–trifluoroethanol to trifluoroacetaldehyde 2,2,2–trifluoroethyl hemiacetal", Tetrahedron Letters 41, 2000, Elsevier Science Ltd., pp. 5873–5876.

Sonoyama, Noriyuki, et al. "Electrochemical Continuous Decomposition of Chloroform and Other Volatile Chlorinated Hydrocarbons in Water Using a Column Type Metal Impregnated Carbon Fiber Electrode", Environmental Science and Technology, Aug. 1999, vol. 33 No. 19, pp. 3438–3442.

* cited by examiner

*Primary Examiner*—William Neuder
(74) *Attorney, Agent, or Firm*—Dann, Dorfman, Herrell & Skillman, P.C.

(57) ABSTRACT

A method is provided for recovering oil from a subterranean oil-bearing formation. One or more pairs of electrodes are inserted into the ground in proximity to a body of oil in said formation. A voltage difference is then established between the electrodes to create an electric field in the oil-bearing formation. As voltage is applied, the current is manipulated to induce oxidation and reduction reactions in components of the oil. The oxidation and reduction reactions lower the viscosity in the oil and thereby reduce capillary resistance to oil flow so that the oil can be removed at an extraction well.

26 Claims, 3 Drawing Sheets

ELECTROCHEMICAL PROCESS FOR EFFECTING REDOX-ENHANCED OIL RECOVERY

CROSS-REFERENCE TO RELATED APPLICATION

This application claims the benefit of U.S. Provisional Patent Application No. 60/335,701, filed Oct. 26, 2001, the entire disclosure of which is incorporated by reference herein.

FIELD OF THE INVENTION

The present invention relates generally to oil production, and more particularly to an improved method for recovering oil from subterranean oil reservoirs with the aid of electric current.

BACKGROUND OF THE INVENTION

When crude oil is initially recovered from an oil-bearing earth formation, the oil is forced from the formation into a producing well under the influence of gas pressure and other pressures present in the formation. The stored energy in the reservoir dissipates as oil production progresses and eventually becomes insufficient to force the oil to the producing well. It is well known in the petroleum industry that a relatively small fraction of the oil in subterranean oil reservoirs is recovered during this primary stage of production. Some reservoirs, such as those containing highly viscous crude, retain 90 percent or more of the oil originally in place after primary production is completed. Oil recovery is frequently limited by capillary forces that impede the flow of viscous oil through interstitial spaces in the oil-bearing formation.

Numerous methods have been proposed for recovering additional oil that remains the in oil-bearing formations following primary production. These secondary recovery techniques generally involve the expenditure of energy to supplement the expulsive forces and/or to reduce the retentive forces acting on the residual oil. A summary of secondary recovery techniques may be found in U.S. Pat. No. 3,782,465, the entire disclosure of which is incorporated by reference herein.

One secondary recovery technique for promoting oil recovery involves the application of electric current through an oil body to increase oil mobility and facilitate transport to a recovery well. Typically, one or more pairs of electrodes are inserted within the underground formation at spaced-apart locations. A voltage drop is established between the electrodes to create an electric field through the oil formation. In some processes, electric current is applied to raise the temperature of the oil formation and thereby lower the viscosity of the oil to facilitate removal. Other methods use electric current to move the oil towards a recovery well by electroosmosis. In electroosmosis, dissolved electrolytes and suspended charged particles in the oil migrate toward a cathode, carrying oil molecules with them. These methods typically use a DC potential source to generate an electrical field across the oil-bearing formation.

Oil recovery methods that utilize electrodes frequently encounter problems affecting the quantity and quality of the recovered oil. Systems using straight DC voltage typically operate under high voltages and currents. In addition, systems using DC current consume relatively large amounts of electricity with corresponding large energy costs.

SUMMARY OF THE INVENTION

With the foregoing in mind, the present invention provides an improved method for stimulating oil recovery from an oil-bearing underground formation through the use of electric current. Electric current is introduced through a plurality of boreholes installed in the formation. In systems using only two boreholes, a first borehole and a second borehole are provided in the proximity of the underground formation. The boreholes are located at spaced-apart locations in or near the formation. A first electrode is placed into the first borehole and a second electrode is placed into the second borehole. A source of voltage is then connected to the first and second electrodes. The second borehole may penetrate the body of oil in the underground formation or be located beyond the oil body, so long as some or all of the oil body is located between the second borehole and the first electrode. The first and second boreholes may penetrate the body of oil to be recovered, or they may penetrate the formation at a point beyond but in proximity to the body of oil.

The first and second electrodes are installed in an electrically conductive formation, such as a formation having a moisture content sufficient to conduct electricity. A DC biased current with a ripple component is applied through the electrodes under conditions appropriate to create an electrical field through the oil formation. The current is regulated to stimulate oxidation and reduction reactions in the oil. As redox reactions occur, long-chain compounds such as heavy petroleum hydrocarbons are reduced to smaller-chain compounds. The decomposition of long-chain compounds decreases the viscosity of the oil compounds and increases oil mobility through the formation such that the oil may be withdrawn at the recovery well. Electrochemical reactions in the formation also upgrade the quality and value of the oil that is ultimately recovered. The system can be used with a multiplicity of cathodes and anodes placed in vertical, horizontal or angular orientations and configurations.

DESCRIPTION OF THE DRAWINGS

The foregoing summary as well as the following description will be better understood when read in conjunction with the accompanying figures, in which.

DETAILED DESCRIPTION OF THE PREFERRED EMBODIMENTS

Figure 1:
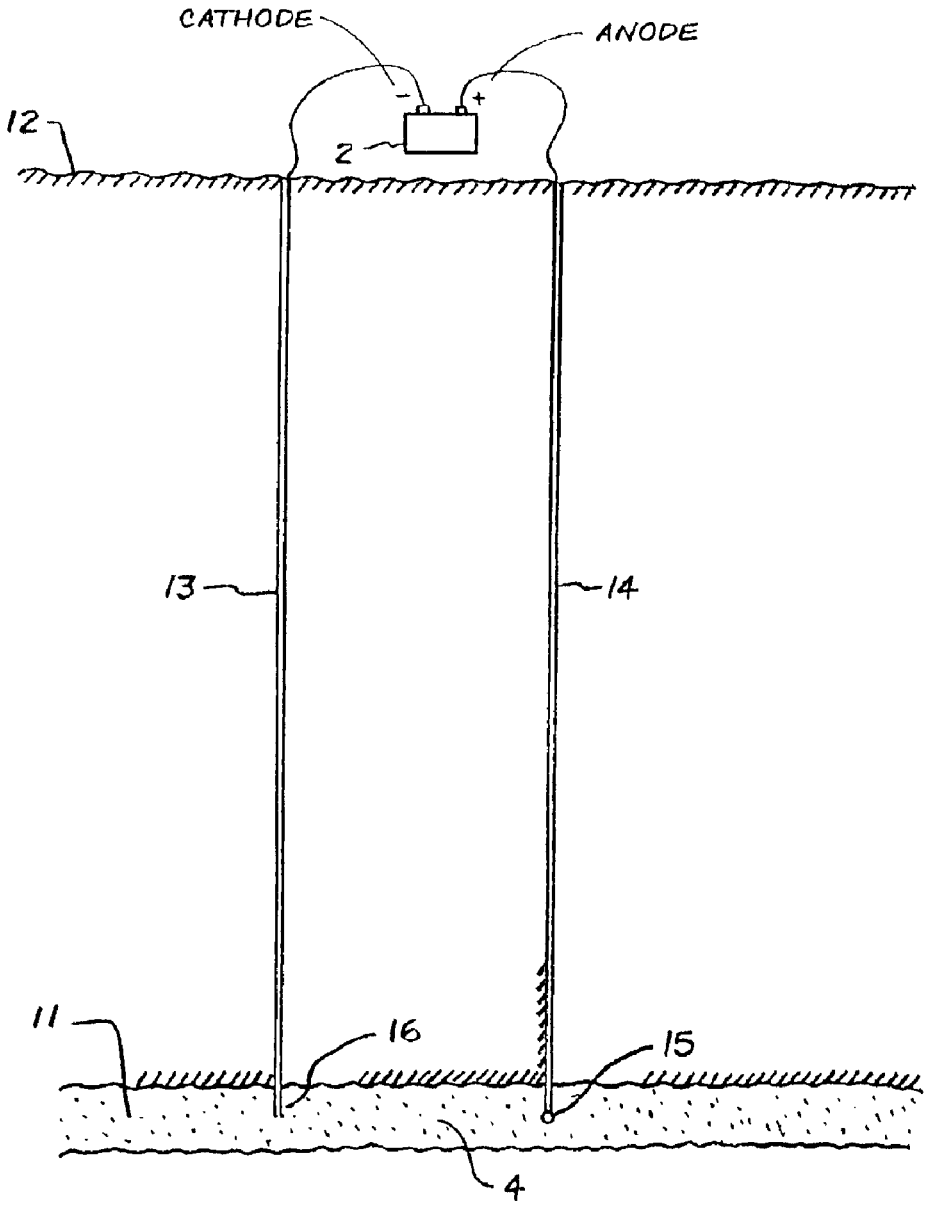
FIG. 1 is a schematic diagram of an improved electrochemical method for stimulating oil recovery from an underground oil-bearing formation.

Referring to the Figures in general, and to FIG. 1, specifically, the reference number 11 represents a subterranean formation containing crude oil. The subterranean formation 11 is an electrically conductive formation, preferably having a moisture content above 5 percent by weight. As shown in FIG. 1, formation 11 is comprised of a porous and substantially homogeneous media, such as sandstone or limestone. Typically, such oil-bearing formations are found beneath the upper strata of earth, referred to generally as overburden, at a depth of the order of 1,000 feet or more below the surface. Communication from the surface 12 to the formation 11 is established through spaced-apart boreholes 13 and 14. The hole 13 functions as an oil-producing well, whereas the adjacent hole 14 is a special access hole designed for the transmission of electricity to the formation 11.

The present invention can be practiced using a multiplicity of cathodes and anodes placed in vertical, horizontal or angular orientations and configurations. In FIG. 1, the system is shown having two electrodes installed vertically into the ground and spaced apart generally horizontally. A first electrode 15 is lowered through access hole 14 to a location in proximity to formation 11. Preferably, first electrode 15 is lowered through access hole 14 to a medial elevation in formation 11, as shown in FIG. 1. By means of an insulated cable in access hole 14, the relatively positive terminal or anode of a high-voltage d-c electric power source 2 is connected to the first electrode 15. The relatively negative terminal on the power source or cathode is connected to a second electrode 16 in producing well 13, or within close proximity of the producing well. Between the electrodes, the electrical resistance of the connate water 4 in the underground formation 11 is sufficiently low so that current can flow through the formation between the first and second electrodes 15, 16. Although the resistivity of the oil is substantially higher than that of the overburden, the current preferentially passes directly through the formation 11 because this path is much shorter than any path through the overburden to "ground."

To create the electric field, a periodic voltage is produced between the electrodes 15, 16. Preferably, the voltage is a DC-biased signal with a ripple component produced under modulated AC power. Alternatively, the periodic voltage may be established using pulsed DC power. The voltage may be produced using any technology known in the electrical art. For example, voltage from an AC power supply may be converted to DC using a diode rectifier. The ripple component may be produced using an RC circuit. Once the voltage is established, the electric current is carried by captive water and capillary water present in the underground formation. Electrons are conducted through the formation by naturally occurring electrolytes in the groundwater.

The electric potential required for carrying out electrochemical reactions varies for different chemical components in the oil. As a result, the desired intensity or magnitude of the ripple component depends on the composition of the oil and the type of reactions that are desired. The magnitude of the ripple component must reach a potential capable of oxidizing and reducing bonds in the oil components. In addition, the ripple component must have a frequency range above 2 hertz and below the frequency at which polarization is no longer induced in the formation. The waveshape of the ripple may be sinusoidal or trapezoidal and either symmetrical or clipped. Frequency of the AC component is preferably between 50 and 2,000 hertz. However, it is understood in the art that pulsing the voltage and tailoring the wave shape may allow the use of frequencies higher than 2,000 hertz.

Figure 2:
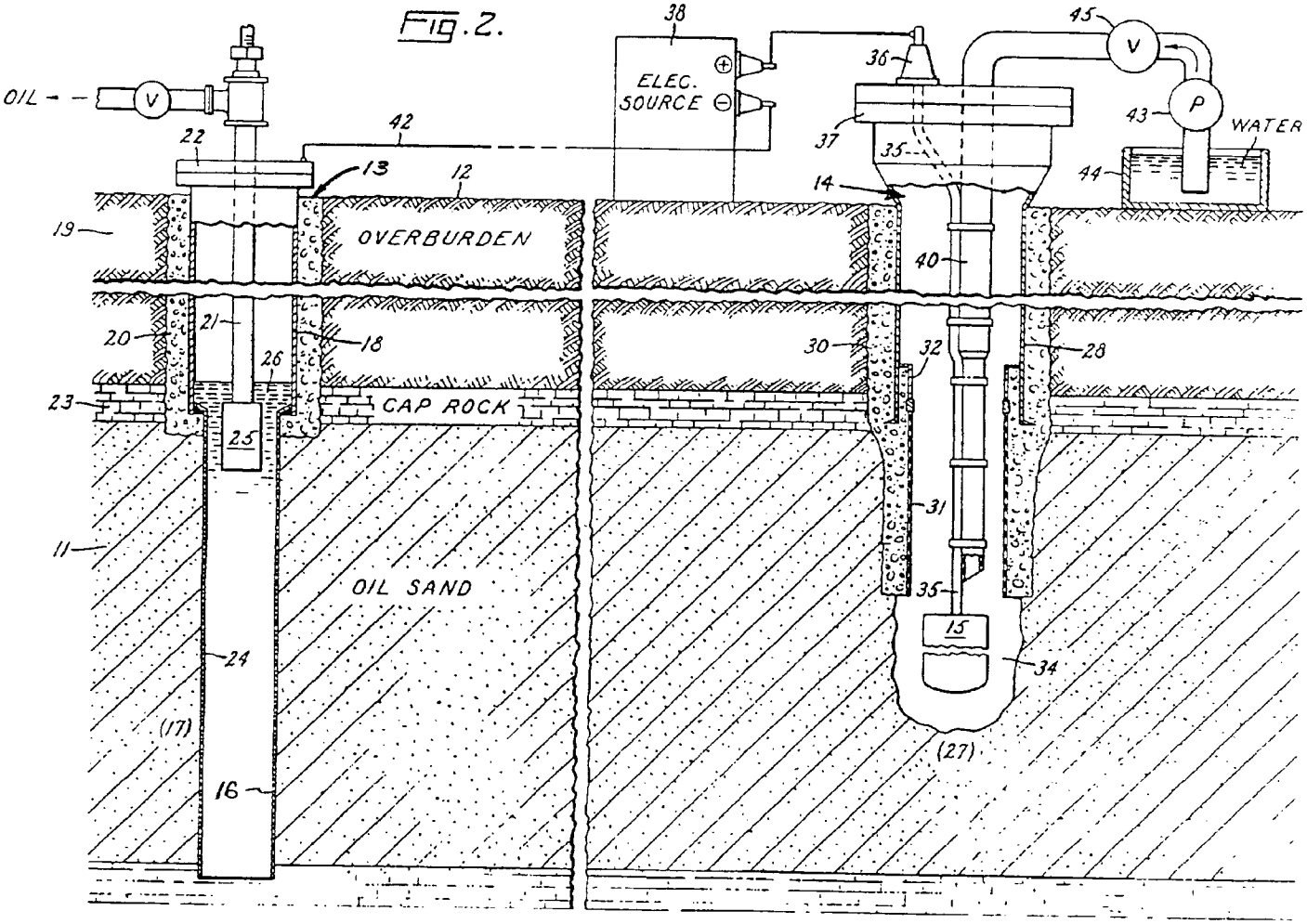
FIG. 2 is a schematic diagram in partial sectional view of an apparatus with which the present method may be practiced.

A system suitable for practicing the invention is shown in FIG. 2. In this system, borehole 13 functions as an oil producing well which penetrates one region 17 of underground oil-bearing formation 11. Well 13 includes an elongated metallic casing 18 extending from the surface 12 to the cap rock 23 immediately above region 17. The casing 18 is sealed in the overburden 19 by concrete 20 as shown, and its lower end is suitably joined to a perforated metallic liner 24 which continues down into the formation 11. Piping 21 is disposed inside the casing 18 where it extends from the casing head 22 to a pump 25 located in the liquid pool 26 that accumulates inside the liner 24. Preferably the producing well 13 is completed in accordance with conventional well construction practice. The pump 25 is selected to operate at sufficient pumping head to draw oil from adjacent formation 11 up through metallic liner 24.

Access hole 14 that contains first electrode 15 includes an elongated metallic casing 28 with a lower end preferably terminated by a shoe 29 disposed at approximately the same elevation as the cap rock 23. The casing 28 is sealed in the overburden 19 by concrete 30. Near the bottom of hole 14, a tubular liner 31 of electrical insulating material extends from the casing 28 for an appreciable distance into formation 11. The insulating liner 31 is telescopically joined to the casing 28 by a suitable crossover means or coupler 32. Although shown out of scale in FIG. 2, liner 31 preferably has a substantial length and a relatively small inside diameter.

Below the liner 31, a cavity 34 formed in the oil-bearing formation 11 contains the first electrode 15. The first electrode 15 is supported by a cable 35 that is insulated from ground. The first electrode 15 is relatively short compared to the vertical depth of the underground formation 11 and may be positioned anywhere in proximity to the formation. Referring to FIG. 2, first electrode 15 is positioned at an approximately medial elevation within the oil-bearing formation 11. The first electrode may be exposed to saline or oleaginous fluids in the surrounding earth formation, as well as a high hydrostatic pressure. Under these conditions, first electrode 15 may be subject to electrolytic corrosion. Therefore, the electrode assembly preferably comprises an elongate configuration mounted within a permeable concentric tubular enclosure radially spaced from the electrode body. The enclosure cooperates with the first electrode body to protect it from oil or other adverse materials that enter the cavity.

Figure 3:
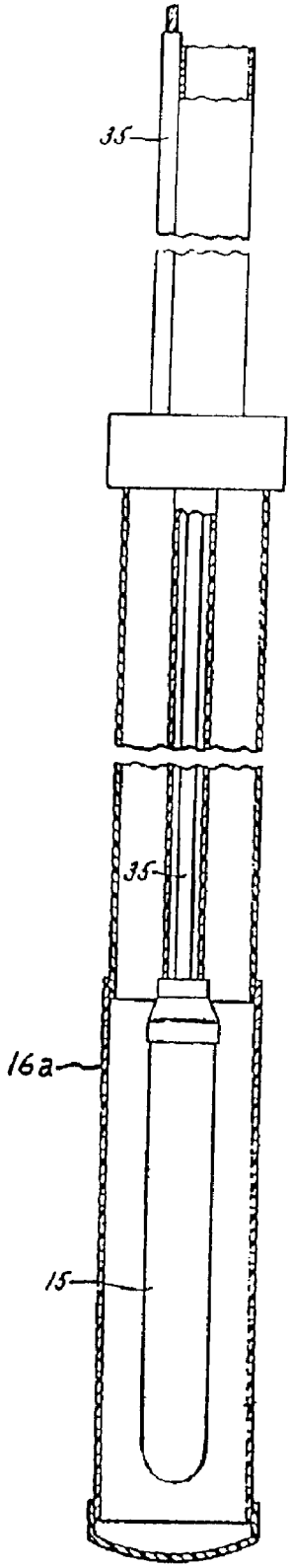
FIG. 3 is an elevational view of an electrode assembly adapted for use in practicing the present invention.

Referring now to FIG. 3, a preferred assembly for the first electrode 15 is shown. The assembly comprises a hollow tubular electrode body 15 electrically connected through its upper end to a conducting cable 35 and disposed concentrically in radially spaced relation within a permeable tubular enclosure 16*a* of insulating material. The first electrode 15 is preferably coated externally with a material, such as lead dioxide, which effectively resists electrolytic oxidation. The assembly preferably includes means to place the internal surfaces of the first electrode 15 under pressure substantially equal to the external pressure to which the first electrode is exposed, thereby to preclude deformation and consequent damage to the first electrode. The enclosure 16*a* is closed at the bottom to provide a receptacle for sand or other foreign material entering from the surrounding formation.

Referring again to FIG. 2, the first electrode 15 is attached to the lower end of insulated cable 35, the other end of which emerges from a bushing or packing gland 36 in the cap 37 of casing 28 and is connected to the relatively positive terminal of an electric power source 38. The other terminal on the electric power source 38 is connected via a cable 42 to an exposed conductor that acts as a second electrode 16 at the producing well 13. The second electrode 16 may be a separate component installed in the proximity of producing well 13 or may be part of the producing well itself. In the embodiment shown in FIG. 2, the perforated liner 24 serves as the second electrode 16, and the well casing 18 provides a conductive path between the liner and cable 42.

Thus far, it has been presumed that electrodes 15, 16 are located in a formation with a suitable moisture content and naturally occurring electrolytes to provide an electroconductive path through the formation. In formations that do not have adequate capillary and captive groundwater to be electrically conductive, an electroconductive fluid may be injected into the formation through one or both boreholes to maintain an electroconductive path between the electrodes 15, 16. Referring to FIG. 2, a pipe 40 in borehole 14 delivers electrolyte solution from the ground surface to the underground formation 11. Preferably, a pump 43 is used to convey the solution from a supply 44 and through a control valve 45 into borehole 14. Borehole 14 is preferably equipped with conventional flow and level control devices so as to control the volume of electrolyte solution introduced to the borehole. A detailed system and procedure for injecting electrolyte solution into a formation is described in the aforementioned U.S. Pat. No. 3,782,465. See also, U.S. Pat. No. 5,074,986, the entire disclosure of which is incorporated by reference herein.

Referring now to FIGS. 1–2, the steps for practicing the improved method for stimulating oil recovery will now be described. An electric potential is applied to first electrode 15 so as to raise its voltage with respect to the second electrode 16 and region 17 of the formation 11 where the producing well 13 is located. The voltage between the electrodes 15, 16 is preferably no less than 0.4 V per meter of electrode distance. Current flows between the first and second electrodes 15, 16 through the formation 11. Connate water 4 in the interstices of the oil formation provides a path for current flow. Water that collects above the electrodes in the boreholes does not cause a short circuit between the electrodes and surrounding casings. Such short circuiting is prevented because the water columns in the boreholes have relatively small cross sectional areas and, consequently, greater resistances than the oil formation.

As current is applied across formation 11, electrolysis in the capillary water and captive water takes place. Water electrolysis in the groundwater releases agents that promote oxidation and reduction reactions in the oil. That is, negatively charged interfaces of oil compounds undergo cathodic reduction, and positively charged interfaces of the oil compounds undergo anodic oxidation. These redox reactions split long-chain hydrocarbons and multi-cyclic ring compounds into lighter-weight compounds, contributing to lower oil viscosity. Redox reactions may be induced in both aliphatic and aromatic oils. As viscosity of the oil is reduced through redox reactions, the mobility or flow of the oil through the surrounding formation is increased so that the oil may be drawn to the recovery well. Continued application of electric current can ultimately produce carbon dioxide through mineralization of the oil. Dissolution of this carbon dioxide in the oil further reduces viscosity and enhances oil recovery.

In addition to enhancing oil flow characteristics, the present invention promotes electrochemical reactions that upgrade the quality of the oil being recovered. Some of the electrical energy supplied to the oil formation liberates hydrogen and other gases from the formation. Hydrogen gas that contacts warm oil under hydrostatic pressure can partially hydrogenate the oil, improving the grade and value of the recovered oil. Oxidation reactions in the oil can also enhance the quality of the oil through oxygenation.

Electrochemical reactions are sufficient to decrease oil viscosities and promote oil recovery in most applications. In some instances, however, additional techniques may be required to adequately reduce retentive forces and promote oil recovery from underground formations. As a result, the foregoing method for secondary oil recovery may be used in conjunction with other prior art processes, such as electrothermal recovery or electroosmosis. For instance, electroosmotic pressure can be applied to the oil deposit by switching to straight d-c voltage and increasing the voltage gradient between the electrodes 15, 16. Supplementing electrochemical stimulation with electroosmosis may be conveniently executed, as the two processes use much of the same equipment. A method for employing electroosmosis in oil recovery is described in U.S. Pat. No. 3,782,465.

Many aspects of the foregoing invention are described in greater detail in related patents, including U.S. Pat. Nos. 3,724,543, 3,782,465, 3,915,819, 4,382,469, 4,473,114, 4,495,990, 5,595,644 and 5,738,778, the entire disclosures of which are incorporated by reference herein. Oil formations in which the methods described herein can be applied include, without limitation, those containing heavy oil, kerogen, asphaltinic oil, napthalenic oil and other types of naturally occurring hydrocarbons. In addition, the methods described herein can be applied to both homogeneous and non-homogeneous formations.

The terms and expressions which have been employed are used as terms of description and not of limitation. Although the present invention has been described in detail with reference only to the presently-preferred embodiments, there is no intention in use of such terms and expressions of excluding any equivalents of the features shown and described or portions thereof. It is recognized that various modifications of the embodiments described herein are possible within the scope and spirit of the invention. Accordingly, the invention incorporates variations that fall within the scope of the following claims.

What is claimed is:

1. An improved method for stimulating recovery of oil from an underground formation comprising a first region and a second region, comprising the steps of:

a. providing a first borehole in the first region and a second borehole in the second region;

b. positioning a first electrode in the first borehole in the first region;

c. positioning a second electrode in proximity to the second borehole in the second region;

d. applying a d-c current through said first and second electrodes to create an electric field through the formation, and e. superimposing an a-c component on the d-c current to effect decomposition of petroleum compounds and decrease viscosity of the oil.

2. The method of claim 1, wherein the step of superimposing an a-c component on the d-c current comprises the step of using an RC circuit.

3. The method of claim 2, wherein the a-c component has a frequency between 50 and 2,000 hertz.

4. The method of claim 1, comprising the step of altering the voltage difference between the first and second electrodes.

5. The method of claim 1, wherein the second electrode comprises a metal liner in said second borehole.

6. The method of claim 1, wherein the voltage difference between the first and second electrodes is between 0.4 and 2.0 V per meter of distance between the first and second electrodes.

7. The method of claim 1, comprising the step of mineralizing a portion of the oil present in said formation to produce carbon dioxide.

8. The method of claim 1, wherein the step of providing a second borehole comprises positioning the second borehole in contact with oil in the underground formation.

9. The method of claim 1, wherein the first and second boreholes contact oil in the underground formation.

10. The method of claim 2, comprising the step of varying the magnitude of the a-c component, whereby oxidation and reduction reactions are stimulated in different oil compounds.

11. The method of claim 1, comprising the further step of applying an increased d-c voltage between the first and second electrodes to impress an electroosmotic force on the oil deposit toward the second borehole.

12. An improved method for stimulating recovery of oil from an underground formation comprising a first region and a second region, comprising the steps of:

a. providing a first borehole in the first region and a second borehole in the second region;

b. positioning a first electrode in the first borehole in the first region;

c. positioning a second electrode in proximity to the second borehole in the second region;

d. applying a d-c current through said first and second electrodes to create an electric field through the formation;

e. superimposing an a-c component on the d-c current to effect decomposition of petroleum compounds and decrease viscosity of the oil;

f. increasing the voltage between the first and second electrodes to impress an electroosmotic force on the oil deposit toward the second borehole; and g. extracting oil from the second borehole.

13. The method of claim 12, wherein the step of superimposing an a-c component on the d-c current comprises the step of using an RC circuit.

14. The method of claim 13, wherein the a-c component has a frequency between 50 and 2,000 hertz.

15. The method of claim 12, comprising the step of altering the voltage difference between the first and second electrodes.

16. The method of claim 12, wherein the second electrode comprises a metal liner in said second borehole.

17. The method of claim 12, wherein the voltage difference between the first and second electrodes is between 0.4 and 2.0 V per meter of distance between the first and second electrodes.

18. The method of claim 12, comprising the step of mineralizing a portion of the oil present in said formation to produce carbon dioxide.

19. The method of claim 12, wherein the step of providing a second borehole comprises positioning the second borehole in contact with oil in the underground formation.

20. The method of claim 12, wherein the first and second boreholes penetrate the oil-bearing formation.

21. The method of claim 13, comprising the step of varying the magnitude of the a-c component, whereby oxidation and reduction reactions are stimulated in different oil compounds.

22. The method of claim 1 or claim 12, comprising the step of controlling the wave shape of the a-c component.

23. The method of claim 22, wherein the wave shape is one of a sinusoidal shape and a trapezoidal shape.

24. The method of claim 22, wherein the wave shape is one of a symmetrical shape and a clipped shape.

25. A method for stimulating recovery of oil from an underground formation comprising a first region and a second region, comprising the steps of:

a. providing a first borehole in the first region and a second borehole in the second region;

b. positioning a first electrode in the first borehole in the first region;

c. positioning a second electrode in proximity to the second borehole in the second region;

d. applying a first voltage gradient with straight d-c voltage and d-c current between the first and second electrodes to create an electric field through the formation;

e. superimposing an a-c component on the d-c current to effect decomposition of petroleum compounds and decrease viscosity of the oil by electrochemical reactions; and f. applying a second voltage gradient with straight d-c voltage and d-c current without the a-c component between said first and second electrodes, said second voltage gradient being greater than the first voltage gradient, to further decrease viscosity of the oil by electrothermal reaction.

26. The method for stimulating recovery of oil from an underground formation of claim 25, comprising the step of applying a third voltage gradient with straight d-c voltage and d-c current without the a-c component between said first and second electrodes to introduce electroosmotic pressure in the oil, wherein the third voltage gradient is greater than the first voltage gradient.

* * * * *